United States Patent [19]

Jackson et al.

[11] Patent Number: 4,488,363

[45] Date of Patent: Dec. 18, 1984

[54] COMBINATION IDLER AND BELT FAILURE SWITCH FOR A DRYER

[75] Inventors: William A. Jackson, Hartford Township, Van Buren County; Gerald L. Kretchman, St. Joseph Township, Berrien County, both of Mich.

[73] Assignee: Whirlpool Corporation, Benton Harbor, Mich.

[21] Appl. No.: 482,522

[22] Filed: Apr. 6, 1983

[51] Int. Cl.[3] ..... F26B 11/04

[52] U.S. Cl. ..... 34/55; 34/133

[58] Field of Search ..... 34/43, 44, 45, 55, 133

[56] References Cited

U.S. PATENT DOCUMENTS

| | | | |
|---|---|---|---|
| 706,009 | 8/1902 | Bassett | 474/135 |
| 3,330,049 | 7/1967 | Helton | 34/139 |
| 3,890,719 | 6/1975 | Braga et al. | 34/55 |
| 3,890,720 | 6/1975 | Nichols | 34/55 |
| 4,300,293 | 11/1981 | Gladysz | 34/133 |
| 4,336,472 | 6/1982 | Czech | 310/68 E |

*Primary Examiner*—Larry I. Schwartz
*Assistant Examiner*—David W. Westphal
*Attorney, Agent, or Firm*—Hill, Van Santen, Steadman & Simpson

[57] ABSTRACT

A combined idler assembly and belt failure switch for a dryer is provided in which the idler assembly is mounted directly to the motor end bell for ensuring precise alignment of the assembly and a centrifugal motor switch is utilized to perform an additional function of terminating dryer operation upon breakage of the drive belt.

11 Claims, 14 Drawing Figures

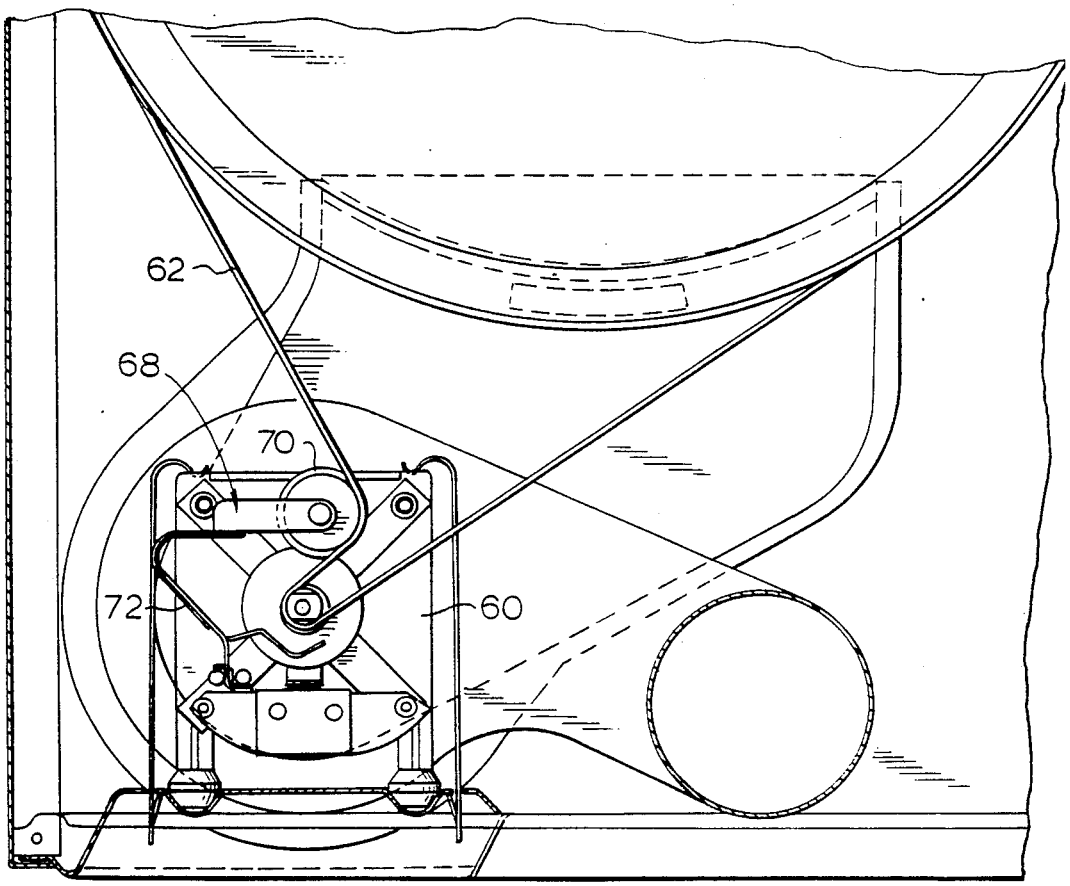
FIG. 3
FIG. 4
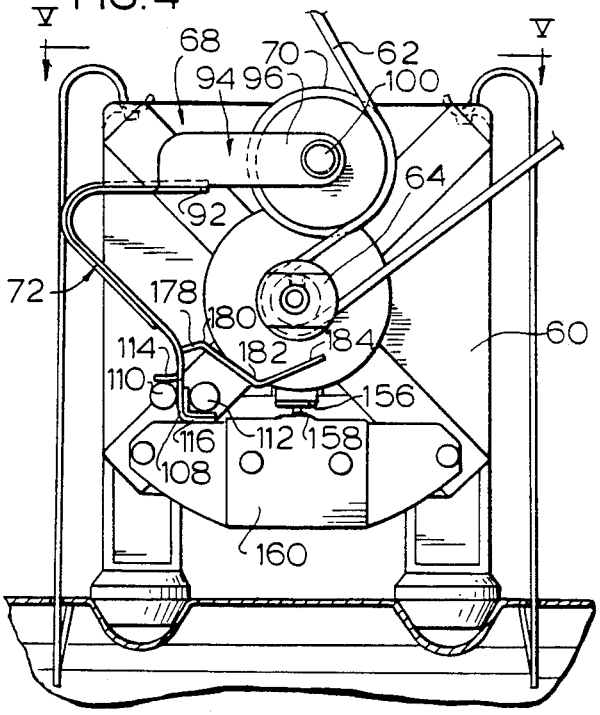
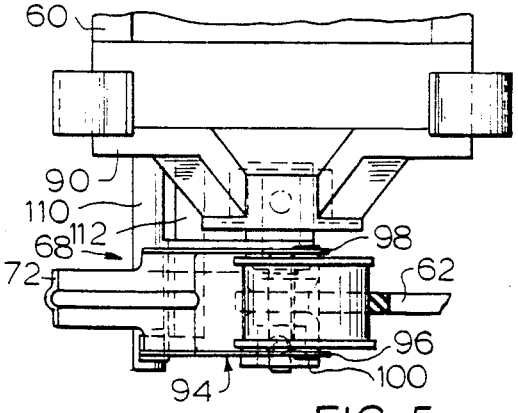
FIG. 5

COMBINATION IDLER AND BELT FAILURE SWITCH FOR A DRYER

BACKGROUND OF THE INVENTION

1. Field of the Invention

This invention relates to automatic clothes drying machines, and more particularly to a combination idler assembly and power disconnect system for automatically terminating operation of a clothes dryer in response to breakage of the dryer drum drive belt.

2. Description of the Prior Art

Power disconnect systems which sense breakage of a drive belt in an automatic clothes dryer are known in the art. U.S. Pat. No. 3,890,719, owned by the assignee of the present application, provides a broken belt power disconnect system for dryers in which a power lead to the drive motor is attached to the idler arm such that when the idler arm moves in response to a broken drive belt, the power lead is separated at a connector thereby terminating power to the motor.

In U.S. Pat. No. 3,890,720, also owned by the assignee of the present application, a switch is positioned such that the switch actuator is contacted by the idler arm when the arm moves in response to breakage of the drive belt. Depression of the switch actuator opens the switch thereby disconnecting power to the electric motor. The drive belt is threaded through a space between the idler pulley and the idler yoke.

U.S. Pat. No. 3,330,049 discloses an idler for a dryer motor belt assembly which is mounted on the motor mounting bracket and U.S. Pat. No. 706,009 discloses a belt idler mounted from the end bell of the motor.

SUMMARY OF THE INVENTION

The present invention provides a means in which the centrifugal switch, normally used to disconnect the starter windings once the electric motor has developed a minimum rotational speed on its drive shaft, can be utilized to disconnect power from the dryer when a broken belt condition is sensed. An idler bracket is mounted directly to the end bell of the motor to provide better alignment of the idler bracket assembly with the belt and switch mechanism.

The idler bracket has a spring arm having a roller or pulley mounted on the end such that the drive belt can be positioned around the drive pulley on the motor with the idler manually biased away from the belt. When the idler is manually released, the spring arm causes the idler to place tension on the belt.

A leg with a foot extending from the arm is spaced from the actuating lever on the motor centrifugal switch. The centrifugal switch is free to operate in its normal mode in response to a centrifugal mechanism responsive to the rotational speed of the electric motor shaft. If the drive belt fails, the spring arm on the idler bracket rotates to a relaxed failure position which causes the foot to operate the actuating lever on the centrifugal switch.

This activation could cause the switch to deactivate both the heat source as well as the motor. It would also be possible to deactivate just the heat source and leave the motor fan running to reduce the heat in the dryer. Other embodiments of the present invention show variations of the same concept of mounting the idler bracket on the end of the motor and using the motor centrifugal switch as a means for stopping the motor and/or heat operation if the belt is broken.

BRIEF DESCRIPTION OF THE DRAWINGS

FIG. 3 is a rear sectional view taken generally along the lines III—III of FIG. 2.

FIG. 4 is an enlarged detail view of the motor and idler assembly shown in FIG. 3 during normal dryer operation.

FIG. 5 is a top elevational view of the idler assembly taken generally along the lines V—V of FIG. 4.

DESCRIPTION OF THE PREFERRED EMBODIMENTS

Figure 1:
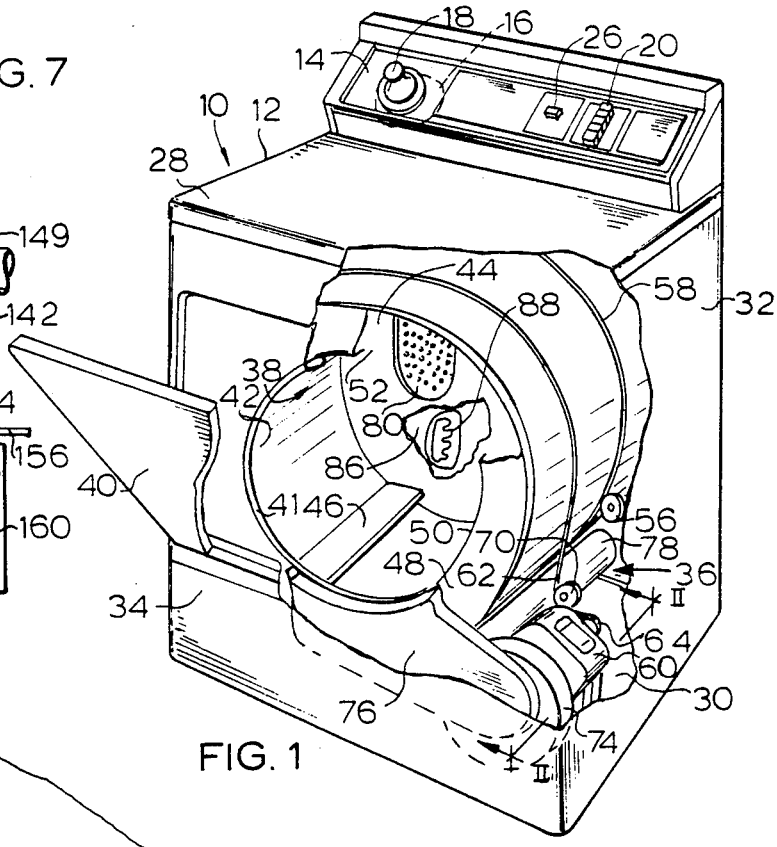
FIG. 1 is a perspective view, partially broken away, of an automatic clothes dryer embodying a combination idler and belt failure switch for a dryer constructed in accordance with the principles of the present invention.

Referring to FIG. 1, a laundry machine or clothes drying appliance 10 is illustrated as comprising an enclosure cabinet or housing 12 with a control console 14 thereon including a control device or timer 16 for regulating the drying operation. A control knob 18 selectively sets the control device 16 for various drying cycles of operation, as for example, automatic or timed drying cycles. Various other controls are housed on the control console 14 including a series of cycle or temperature selection switches 20 which allow the user to select different temperature settings for the drying operation. A push to start button 26 is also provided on the control panel 14.

The enclosure cabinet or housing 12 comprises a horizontal top panel 28 and a horizontal bottom panel or base 30, a pair of vertical side panels 32 (only one shown), a vertical front panel 34 and a vertical rear panel 36. An access opening 38, having a closure door 40, is provided in the front panel 34 for loading and unloading the clothes drying appliance or dryer 10.

The dryer 10 further includes a fabric treatment zone or drying container for tumbling clothes, in the form of a rotatable drum 42 housed within the cabinet 12 and extending axially from the front panel 34 to a bulk head 44 spaced forwardly of the rear panel 36. In order to encourage tumbling action in the clothing being dried, a plurality of circumferentially spaced baffles 46 (only one being illustrated) are mounted on the inner surface of the drum 42.

The drum 42 includes a radially inwardly extending front closure wall 48 having an access opening 50 therein formed by means of an axially out-turned flange 52. The flange 52 provides a forwardly extending bearing annulus which overlies and is suitably journalled on the complementary flange 41 of the cabinet front panel 34. It will be apparent from the foregoing that the opening 50 into the drum 42 and the opening 38 formed in the front panel 34 are substantially concentric, providing access into the rotatable drum 42 from outside the cabinet 12. The drum 42 is supported at the rear by a pair of support rollers 56 (only one being illustrated) mounted on the bulk head 44. A raceway or circumferential groove 58 indented in the peripheral wall of the rear portion of the drum 42 serves as a track for the rollers 56.

Figure 2:
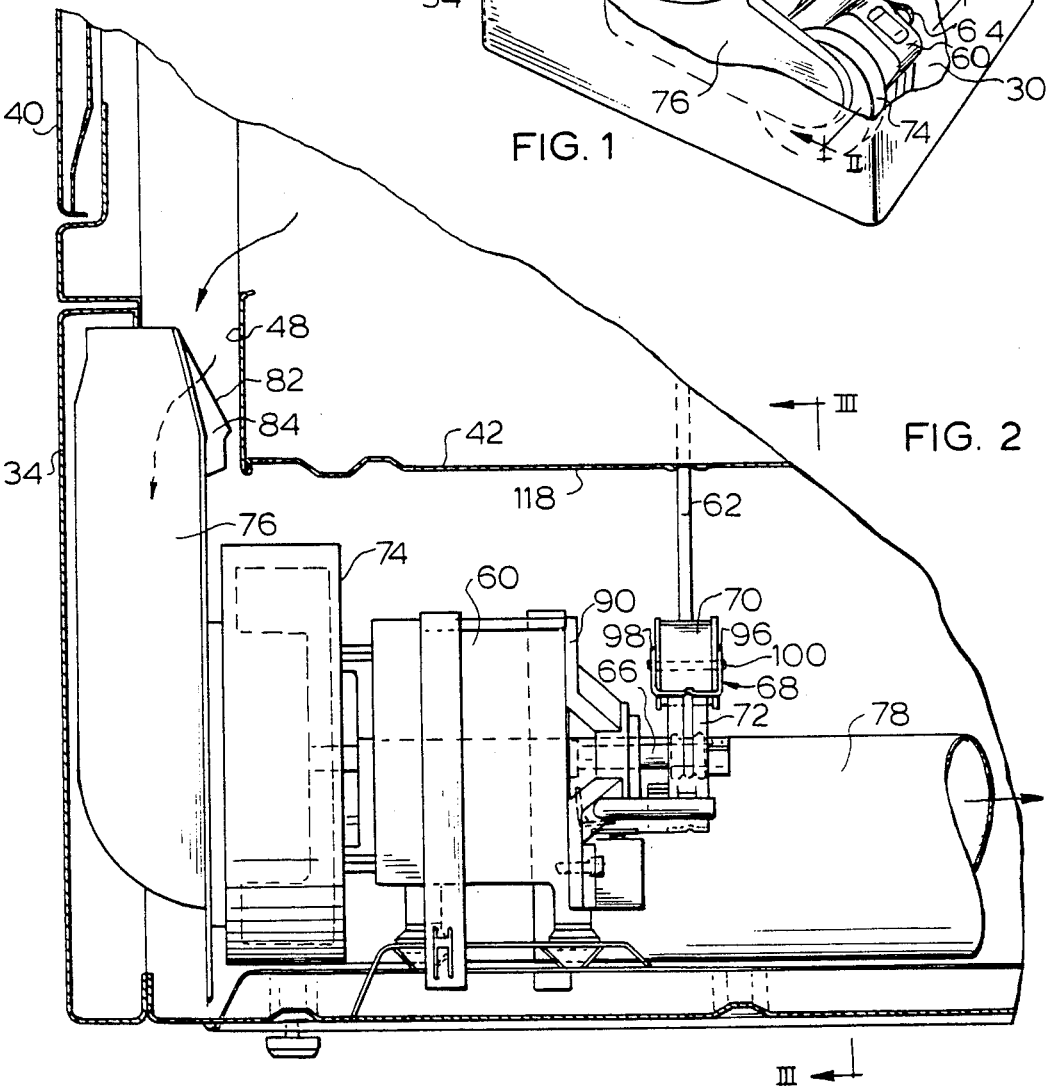
FIG. 2 is a partial sectional view of the motor and idler assembly of the present invention.

A drive motor 60 is mounted on the bottom panel or base 30 near a front corner of the cabinet 12 and rotatably drives the drum 42 by means of a transmission. In accordance with the present invention, a tensioned transmission member or endless drive belt 62, extends around the periphery and in frictional engagement with the drum 42 and around a motor drive pulley 64 mounted at one end of a motor shaft 66 (FIG. 2). An idler system or device 68 has an idler wheel or pulley 70 rotatably mounted on a resilient idler arm or bracket 72 such that the idler wheel 70 is biased against and tensions the drive belt 62.

Referring to FIGS. 1 and 2, the other end of the motor shaft 66 drives a blower 74, arranged to circulate air through the drum 42. The blower 74 is attached to a warm air duct 76 positioned between the front panel 34 and the front closure wall 48 of the drum 42. The blower directs warm moist air out through an exhaust conduit 78 to exit through the rear panel 36 of the dryer cabinet 12.

The bulk head 44 serves to enclose the open ended rear portion of the drum 42 and provides a fixed rear wall in which to locate an opening comprising an air inlet 80. The blower 74 draws moisture laden air from the interior of the drum 42 through an outlet 82, through a removable lint screen 84, through the warm air duct 76, through the blower 74 and out of the cabinet 12 through the exhaust conduit 78. Air exhausted from the drum 42 is replaced by ambient air entering the dryer by way of an air intake opening (not shown) in the rear panel 36, the ambient air being drawn through a fresh air duct 86, passing over a heater means 88 and into the drum 34 through the inlet 80. Thus, a stream of warm air is circulated through the drum 42, from the rear bulk head 44 toward the front wall 48 of the drum, subjecting clothing placed therein to a drying environment to remove moisture from the fabrics while the clothing is tumbled as the drum rotates.

Referring now to FIGS. 2 through 6, one embodiment of a power disconnect system is illustrated. The idler assembly 68 is connected directly to an end bell 90 of the motor 60 to ensure proper alignment of the idler pulley 70 with the drive belt 62. Specifically, the idler assembly 68 is comprised of the resilient arm 72 which has at a first end 92 including a yoke 94 having a pair of arms 96, 98 which carry the idler pulley 70 by means of a shaft 100 extending between the arms 96, 98. The resilient arm is shown in an unbiased or unstressed position in FIG. 6 where it is seen that the arm 72 is comprised of two linear segments 102, 104 which are connected by a bight 106 intermediate the ends of the arm 72.

The first end 92 carrying the yoke 94 is on linear segment 102 and a second end 108 of the arm 72 is captured between two posts 110, 112 which extend axially outwardly from the end bell 90 of the motor 60. The arm 72 has a portion on linear segment 104 near end 108 which extends between the two posts 110, 112. This portion has a first foot member 114 extending perpendicular to the arm 72 which abuts post 110 in an overlying manner and a second foot member 116 extending perpendicular to the arm 72 which abuts post 112 in an underlying manner. In this arrangement end 108 is restrained in a vertical direction and is restrained from rotating in a counterclockwise direction between the two posts 110, 112 as viewed from the drive pulley end of the motor 60.

Figure 6:
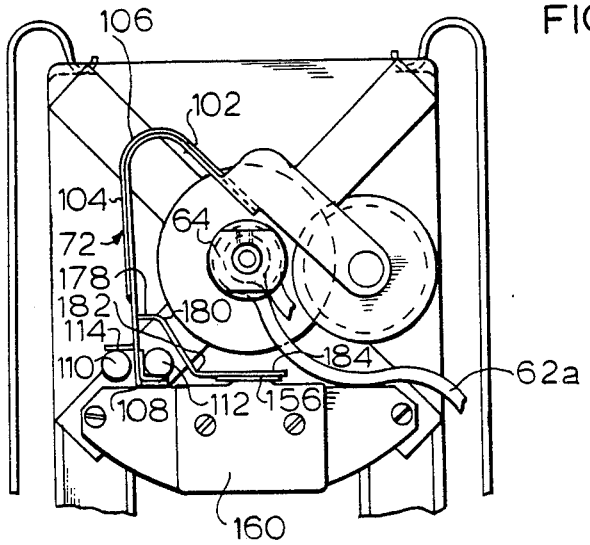
FIG. 6 is an enlarged detail view of the motor and idler assembly shown in FIG. 3 showing a broken belt condition.

The idler assembly can be easily assembled onto the end bell 90 of the motor by positioning the arm 72 slightly clockwise of the normal position shown in FIG. 6 and sliding the second end 108 between the two posts 110, 112 with the first foot 114 above post 110 and the second foot 116 below post 112. As the assembly is then rotated counterclockwise to its normal position, the second end 108 will be securely restrained by the posts 110, 112.

When the drive belt 62 is assembled onto the drum and motor, the belt is first slipped over the exterior surface 118 of the drum 42 where it can frictionally engage surface 118 to drive the drum. The belt is then pulled over the drive pulley 64 while the idler pulley 70 is manually biased in a counterclockwise direction about its restraining point between the posts 110 and 112. Once the belt 62 is positioned on the drive pulley 64, the manual tension on the idler assembly can be released and the idler pulley 70 will be caused to move in a clockwise direction due to the resiliency of arm 72 and will place tension on the belt 62, assuming the position shown in FIGS. 2 through 5.

Thus, during normal operation of the dryer, the idler pulley 70 maintains an appropriate amount of tension on the driver belt 62 such that rotation of the drive pulley 64 on the motor shaft 66 causes rotation of the dryer drum 42. However, if the driver belt 62 breaks during operation, the motor 60 would continue to operate as would the heating element 88, but the drying action would be ineffective since the clothes would not be tumbling within the dryer drum 42. Therefore, it has been found desirable to employ a shut-off switch to prevent operation of the heating element and the motor in the event that such belt breakage would occur.

Addition of a switch which is activated by movement of the idler arm occasioned by belt breakage has been suggested by the prior art. However, it would be desirable from cost, manufacturing and servicing standpoints if the use of an additional switch could be avoided. The present invention avoids the use of an additional switch by utilizing a switch present at the motor end bell 90 to perform this additional function.

Figure 7:
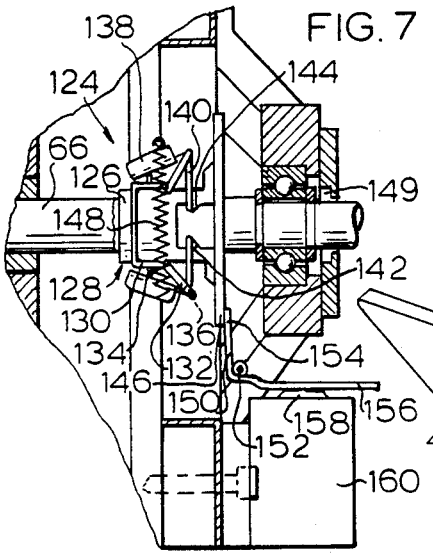
FIG. 7 is a partial sectional view of the centrifugal switch mechanism and actuator.

Electric motors are commonly constructed with two sets of windings, the start windings and the run windings. Both of these windings are energized together during an initial period upon energization of the motor when the starting torque is high, and a centrifugal switch disconnects the start winding when the motor attains a preselected speed. Such a switch and appropriate linkage to a velocity responsive centrifugal mechanism is shown in FIG. 7 and is described in detail in U.S. Pat. No. 4,336,472 owned by the assignee of the present application. That disclosure is incorporated herein by reference. A portion of that disclosure is included for assisting in the description of the present invention.

Referring to FIG. 7, a centrifugal mechanism 124 consists of a collar 126 press fitted on the motor shaft 66 over a knurled portion 128 for corotation therewith. The collar 126 has two arms 130, each extending outwardly to an angular arm 132. Each arm is provided with a tab 134 extending outwardly to form a stop. The angular arms 132 are each punched out in a manner to provide a transverse elongated slot 136 to provide a bearing surface for a pair of weights 138. The weights 138 are angular in shape to provide a bifurcated arm 140 having fingers 142. The fingers 142 extend loosely into recesses 144 on a slidable collar 146. Springs 148 bias the weights 138 against the stops 134. The collar 146 is slidably mounted on shaft 66 so that as shaft 66 gains rotational velocity, the weights 138 will move outwardly against the bias of the springs 148, pivoting the arms 140 to slide the collar 146 away from a shaft bearing 149, thus moving the collar 146 from an initial rest position to a final running position.

A lever 150 is pivotally attached to the motor end bell 90 at 152 and has a first portion 154 which is movable by the collar 146 and a second portion 156 which overlies a portion of a spring biased actuator button 158 of a centrifugal switch 160. Movement of the collar 146 to the running position allows pivoting of the lever 150 counterclockwise about pivot point 152, thereby allowing the actuator 158 to move to the running position. With the actuator 158 of switch 160 in the running position current is disconnected from the start windings of the motor thereby permitting the motor to operate only on the run windings.

Figure 8:
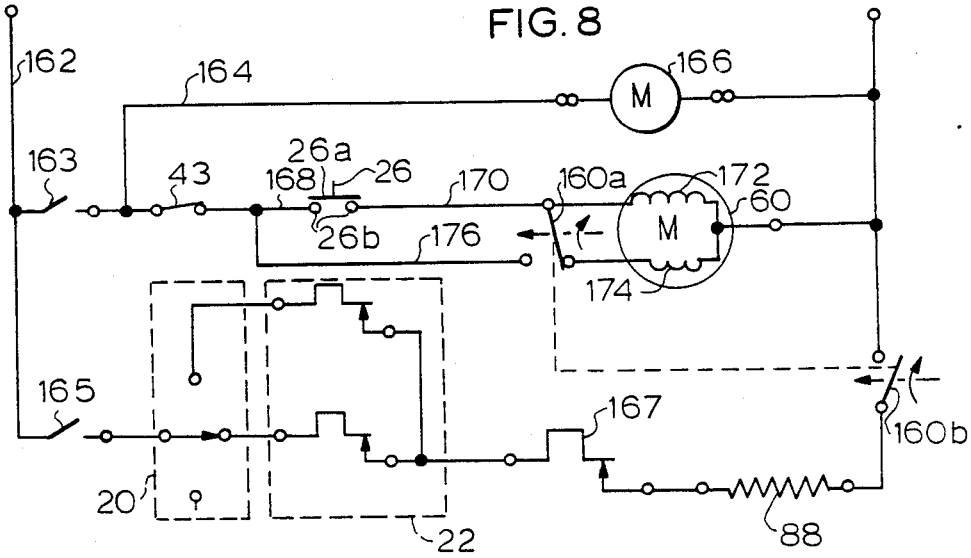
FIG. 8 is a schematic diagram of the electrical system of a dryer embodying the present invention.

A schematic diagram of the electrical circuitry utilized in the dryer is shown in FIG. 8. Current is supplied on electrical line 162 and if time has been selected on timer control device 16, then current is supplied through a timer controlled switch 163 along electrical line 164 to a timer motor 166. When the door 40 to the dryer is closed, a switch 43 operating in conjunction with the door closes and supplies current to electrical line 168. Then when the push to start button 26 is depressed, the normally open switch contacts **26*a* and 26*b* are closed and current is supplied to electrical line 170**.

When the motor 60 is first energized, line 170 is connected directly to run windings 172 of the motor and indirectly through switch contacts **160*a* to start windings 174. Once the shaft of the motor has attained the preselected rotational speed, the actuator 158 of switch 160 is released by lever portion 156 causing the current connection from line 168 to pass through electrical line 176 and switch contacts 160*a* to the run windings 172 only. At this point, the push to start button 26 can be released and the motor will continue running on the run windings 172 only. The start windings 174 will have been disconnected by switch contacts 160*a***.

Switch 160 also operates a second set of contacts **160*b* in a circuit which includes the temperature selecting switch 20, thermostats 22, timer controlled contacts 165, a safety thermostat 167, and the heating element 88. While the actuator 158 of switch 160 is depressed, the contacts 160*b* in the circuit including the heating element and temperature selection switches will be open, thereby preventing operation of the heater 88**. Once the motor shaft has achieved the preselected rotational speed, the contacts in this portion of the circuit will close thereby permitting the appropriate heating operation.

In order to utilize switch 160 for the function of terminating operation of the dryer when the drive belt 62 breaks (FIGS. 4 and 6), the resilient idler arm 72 is provided with a leg 178 on linear segment 104 projecting perpendicularly to the arm 72. The leg 178 has two bends 180, 182 intermediate its ends and a foot portion 184 which is perpendicular to and spaced from the arm 72 when in the normal unbiased position. This foot portion 184 is positioned so as to overlie a portion of the lever portion 156 and thus actuator 158 that when the resilient arm 72 is in the relaxed position shown in FIG. 6, the foot portion 184 will depress the actuator 158. However, when the arm 72 is in the flexed position shown in FIG. 4, the foot portion 184 will be raised away from the lever portion 156 and actuator 158.

During normal operation of the dryer with the idler pulley 70 tensioning the belt 62, the foot portion 184 will be positioned away from the lever portion 156 thereby allowing switch 160 to be operated in the normal manner as a centrifugal switch for the motor. However, if the belt 62 should break as is shown by the broken belt **62*a* in FIG. 6, the resilient arm 72 of the idler assembly 68 will move to its relaxed position causing the foot portion 184 to contact lever portion 156 and depress the actuator 158 of switch 160. Referring again to the schematic diagram of FIG. 8, when this occurs, the switch contacts 160*a* and 160*b* will move to the positions shown in the diagram thereby opening the circuit which includes the heating element 88 and also disconnecting the current source from the run windings 172 of the motor 60. Thus, the operation of the dryer will be terminated. It can be appreciated that modifications can be made such that lever 156 would deactivate only contacts 160*b***. leaving the motor in operation if the belt should break.

Figure 9:
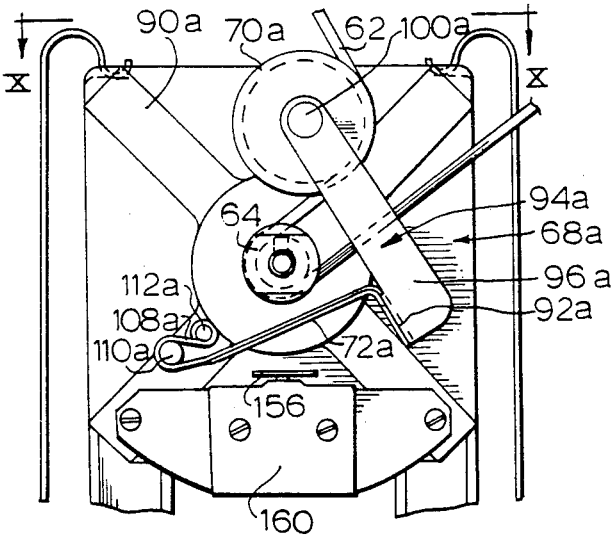
FIG. 9 is a rear elevational view of an alternative embodiment of the present invention during normal dryer operation.
Figure 10:
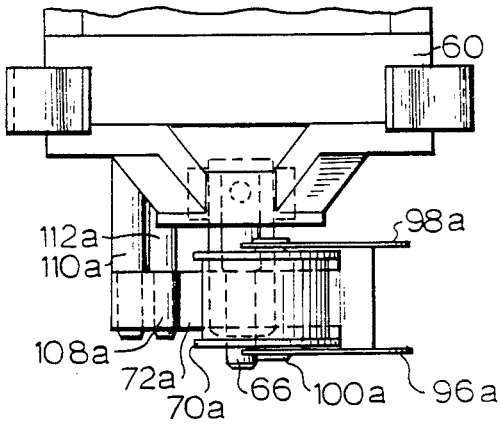
FIG. 10 is a top elevational view taken generally along the lines X—X in FIG. 9.
Figure 11:
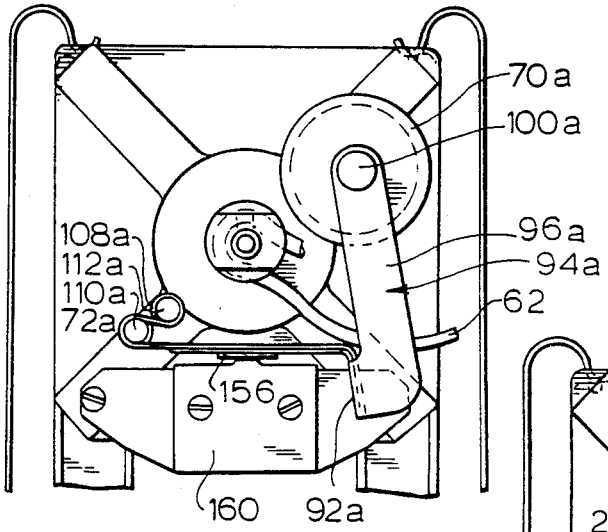
FIG. 11 is a rear elevational view of the alternative embodiment shown in FIGS. 9 and 10 showing a broken belt condition.

An alternative embodiment of the present invention is shown in FIGS. 9 through 11 which uses an alternate idler assembly **68*a*. In this embodiment, a resilient arm 72*a* is utilized which has at a first end 92*a* including a yoke 94*a* comprising two arms 96*a*, 98*a* which carry an idler pulley 70*a* on a shaft 100*a*. A second end 108*a* of the resilient arm 72*a* is retained by a pair of posts 110*a*, 112*a* on end bell 90*a*. The end 108*a* of the arm 72*a* is wrapped around the two posts 110*a*, 112*a* to restrain the arm 72*a* from movement. In the relaxed position, the arm 72*a*, as shown in FIG. 11, overlies and depresses the lever portion 156 and actuator 158 of switch 160. When the arm 72*a* is in the tensioned position during normal operation of the dryer, as shown in FIG. 9, the arm 72*a* is held away from the lever portion 156 and actuator 158 of switch 160**.

Therefore, in normal operation of the dryer, the arm **72*a* will be held away from the actuator 158 and the switch 160 will be operated normally as the centrifugal switch. However, if the drive belt 62 should break, such as shown in FIG. 11, the arm 72*a* will move to its relaxed position, thereby depressing actuator 158** and causing the switch to function as a power disconnection switch in response to the sensing of a broken belt.

Figure 12:
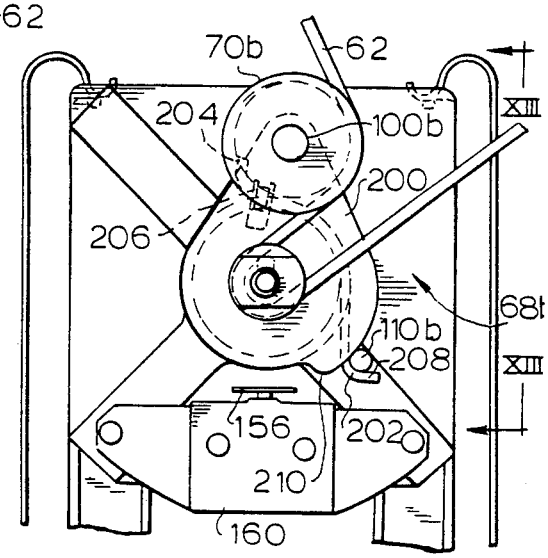
FIG. 12 is a rear elevational view of another alternative embodiment of the present invention during normal dryer operation.
Figure 13:
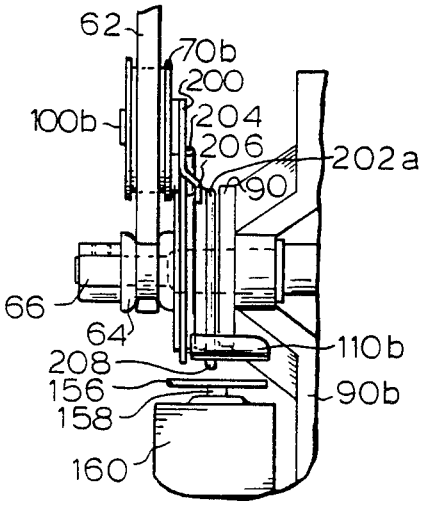
FIG. 13 is a top elevational view taken generally along the lines XIII—XIII in FIG. 12.
Figure 14:
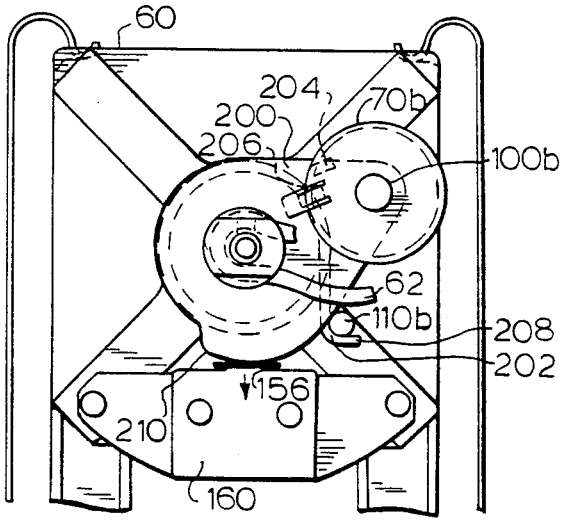
FIG. 14 is a rear elevational view of the alternative embodiment of FIGS. 12 and 13 showing a broken belt condition.

Another embodiment of the present invention is shown in FIGS. 12 through 14 which show an alternate idler assembly **68*b*. In this embodiment, an idler pulley 70*b* is carried on a shaft 100*b* which is mounted on an idler bracket 200. The idler bracket 200 is mounted concentrically about the drive shaft 66 and is restrained from rotational movement in a counterclockwise direction by a spring element 202. The spring 202 is secured at a first perpendicularly bent end 204 to the idler bracket 200 by a mounting clip 206 which captures the end 204. A second end 208 of the spring 202 is also bent at right angles and is captured by a post 110*b* extending from the motor end bell 90*b*. An intermediate portion 202*a* of the spring 202 is wrapped to form a coil lying between the idler bracket 200 and the end bell 90 so as to cause an increase in tension within the spring if the idler bracket 200 is rotated in a counterclockwise direction about the drive shaft 66**.

The idler bracket 200 has a cam surface 210 formed along one edge which engages and depresses the lever portion 156 and thus actuator 158 of switch 160 when the idler bracket 200 is in a position with spring 202 relaxed. However, when the idler bracket 200 is rotated counterclockwise, tensioning spring 202, the cam surface 210 is rotated away from lever portion 156 thereby disengaging contact between the cam surface 210 and the actuator.

In normal operation of the dryer, the idler bracket 200 is rotated about the drive shaft 66 so that the idler pulley **70*b* will provide the requisite tension on belt 62. In this configuration, shown in FIG. 12, the cam surface 210 is rotated away from contact of the actuator 158 of switch 160 thereby permitting switch 160 to act in its normal manner as a centrifugal switch for the motor 60. However, if the belt 62 should break, the tension within spring 202 will cause the idler bracket to rotate to the position shown in FIG. 14 in which the cam surface 210 will contact lever portion 156 and depress actuator 158 thereby causing switch 160 to disconnect power to the motor 60 and heating element 88**, terminating operation of the dryer.

Therefore, it is seen that the present invention provides an idler assembly which can be mounted directly to the end bell of the motor assuring proper alignment of the idler pulley with the drive belt, and parts of the idler bracket with the belt failure switch. Also, the present invention permits the utilization of a single switch to provide two separate and distinct functions, those of operating as a centrifugal switch for the motor during normal dryer operation and for terminating operation of the dryer upon indication of a belt breakage.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a clothes dryer having a rotating receptacle for receiving clothes to be dried, a motor for driving the receptacle, said motor having an end bell, and a continuous belt for drivingly connecting said motor to said receptacle, a combination idler and broken belt shut-off comprising:

a motor centrifugal switch, said centrifugal switch actuated to maintain operation of the motor when the motor operates above a given speed of rotation;

a spring biased idler bracket mounted on said end bell;

an idler pulley supported and biased by said bracket to maintain tension on said belt; and linkage means interconnecting said pulley and said centrifugal switch for deactuating said switch to cease operation of said motor in response to the breaking of said belt.

2. In a clothes dryer having a rotating receptacle for receiving clothes to be dried, a motor for driving the receptacle, said motor having an end bell and a rotating shaft passing through the end bell, and a continuous belt for drivingly connecting said motor to said receptacle, an idler mechanism for maintaining tension on said belt comprising:

a motor pulley on said rotating shaft engaging said belt;

a spring arm bracket having first and second ends, said first end mounted to said end bell;

an idler pulley supported by the second end of said bracket, said bracket biasing said idler pulley against said belt adjacent said motor pulley; and a motor centrifugal switch, said centrifugal switch actuated to maintain operation of said motor when said motor operates above a given speed of rotation and said spring arm bracket engageable with said switch for deactivating said switch to cease operation of said motor whenever said belt is broken.

3. In an automatic clothes dryer having a rotating drum for receiving a load of clothes to be dried, an electric motor having an end bell and a rotatable shaft protruding from the end bell, an endless belt providing a driving connection between said shaft and said drum, and an idler assembly supplying tension to said belt, the improvement of said idler assembly comprising a spring mounted idler bracket with an idler pulley mounted by means of a shaft secured to said bracket, said idler pulley having a relaxed position, said spring mounted idler bracket biasing said pulley against said endless belt toward the relaxed position;

a switch mounted near said motor shaft and actuatable by a centrifugal mechanism to maintain operation of said motor when said shaft rotates above a preselected rotational speed, said idler bracket having a portion thereof overlying said switch, said portion operable to deactuate said switch when said idler bracket moves toward said relaxed position upon breakage of said belt, whereby said motor operation will be terminated in response to breakage of said belt.

4. The device of claim 3 wherein said idler assembly is mounted directly to said motor end bell for ensuring proper alignment of the idler assembly with the belt and switch.

5. The device of claim 3 wherein said idler bracket is comprised of a resilient arm member secured at one end to said motor end bell.

6. The device of claim 5 wherein said resilient arm member is secured by means of two posts protruding from said end bell engaging a portion of said arm member at said secured end.

7. The device of claim 3 wherein said idler bracket has a resilient portion with an extending leg and a foot portion overlying said switch, said foot portion engaging an actuator on said switch when said bracket moves to said relaxed position.

8. The device of claim 3 wherein said idler bracket has a cam surface thereon which engages an actuator of said switch when said bracket moves to said relaxed position.

9. The device of claim 8 wherein said idler bracket is spring mounted to rotate about said motor shaft.

10. The device of claim 9 wherein said idler bracket is spring mounted by means of a spring clamped at one end to said bracket and captured at a second end by a post protruding from said end bell.

11. In a clothes dryer of the type having a rotatable clothes receptacle, a combination idler and broken belt shut-off comprising:

motor drive means having a continuous belt drivingly connected to the receptacle;

a motor centrifugal switch means actuated to maintain operation of the motor when the motor operates above a given speed of rotation;

a spring biased idler bracket carried by said motor drive means and having an idler pulley to engage and tension said belt; and linkage means operatively interconnecting said idler pulley and said centrifugal switch means for deactuating said switch to deenergize said motor whenever said belt is broken.

* * * * *